US010395813B2

(12) United States Patent
Uemoto et al.

(10) Patent No.: US 10,395,813 B2
(45) Date of Patent: Aug. 27, 2019

(54) MAGNETIC CORE AND PROCESS FOR PRODUCING SAME

(71) Applicant: NTN CORPORATION, Osaka (JP)

(72) Inventors: Ikuo Uemoto, Mie (JP); Shinji Miyazaki, Mie (JP); Takuji Harano, Mie (JP); Natsuhiko Mori, Mie (JP); Hiroyuki Noda, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 14/433,002

(22) PCT Filed: Sep. 27, 2013

(86) PCT No.: PCT/JP2013/076195
§ 371 (c)(1),
(2) Date: Apr. 1, 2015

(87) PCT Pub. No.: WO2014/054514
PCT Pub. Date: Apr. 10, 2014

(65) Prior Publication Data

US 2015/0270050 A1 Sep. 24, 2015

(30) Foreign Application Priority Data

Oct. 1, 2012 (JP) ..... 2012-219306

(51) Int. Cl.
*H01F 27/255* (2006.01)
*H01F 1/22* (2006.01)
(Continued)

(52) U.S. Cl.
CPC ..... *H01F 27/255* (2013.01); *B22F 1/0062* (2013.01); *H01F 1/22* (2013.01);
(Continued)

(58) Field of Classification Search
None
See application file for complete search history.

(56) References Cited

U.S. PATENT DOCUMENTS 4,272,749 A * 6/1981 Tuji ..... H01F 17/062 148/104
4,502,982 A 3/1985 Horie
(Continued)

FOREIGN PATENT DOCUMENTS

JP 32-5052 B 7/1957
JP 47-22514 B1 6/1972
(Continued)

OTHER PUBLICATIONS

Machine translation of JPH04-254305, Sep. 1992.*
(Continued)

*Primary Examiner* — Xiaowei Su
(74) *Attorney, Agent, or Firm* — Hedman & Costigan, P.C.; James V. Costigan; Kathleen A. Costigan

(57) ABSTRACT

The present invention provides a magnetic core which can be produced with improved productivity without increasing a material cost and has required magnetic and mechanical properties and a process for producing the same. The magnetic core is produced by compression molding and thereafter thermally hardening iron-based soft magnetic powder having resin films formed on surfaces of particles thereof. The resin film is an uncured resin film formed by dry mixing the iron-based soft magnetic powder and epoxy resin containing a latent curing agent with each other at a temperature not less than a softening temperature of the epoxy resin and less than a thermal curing starting temperature thereof. The iron-based soft magnetic powder having the resin films formed on the surfaces of the particles thereof is compression molded by using a die to produce a compression molded body. The compression molded body having the resin films
(Continued)

formed on the surfaces of the particles thereof is thermally hardened at a temperature not less than the thermal curing starting temperature of the epoxy resin.

8 Claims, 8 Drawing Sheets

(51) Int. Cl.

| | |
|---|---|
| ***H01F 41/02*** | (2006.01) |
| ***H01F 1/26*** | (2006.01) |
| ***H01F 3/08*** | (2006.01) |
| ***B22F 1/00*** | (2006.01) |

(52) U.S. Cl.
CPC ..... *H01F 1/26* (2013.01); *H01F 3/08* (2013.01); *H01F 41/0246* (2013.01); *B22F 2998/10* (2013.01); *C22C 2202/02* (2013.01)

(56) References Cited

U.S. PATENT DOCUMENTS

| | | | | |
|---|---|---|---|---|
| 5,160,447 | A | 11/1992 | Ishikawa | |
| 2004/0209120 | A1 | 10/2004 | Inoue | |
| 2012/0286909 | A1* | 11/2012 | Ohwaki | H01F 1/24 335/297 |

FOREIGN PATENT DOCUMENTS

| | | | | |
|---|---|---|---|---|
| JP | 49-4197 | A | 1/1974 | |
| JP | 01-220407 | A | 9/1989 | |
| JP | H04-080901 | A | 3/1992 | |
| JP | 04-254305 | A | 9/1992 | |
| JP | 05-188650 | A | 7/1993 | |
| JP | H09-223618 | A | 8/1997 | |
| JP | 2002-313621 | A | 10/2002 | |
| JP | 2003-124035 | A | 4/2003 | |
| JP | 2003-189560 | A | 7/2003 | |
| JP | 2008-063650 | A | 3/2008 | |
| JP | 2008-066531 | A | 3/2008 | |
| JP | 2008-244128 | A | 10/2008 | |
| JP | 2008-270539 | A | 11/2008 | |
| JP | 2009-029842 | A | 2/2009 | |
| JP | 2009-295671 | A | 12/2009 | |
| JP | 4759533 | B2 | 8/2011 | |
| JP | WO 2012010958 | A2 * | 1/2012 | B22F 1/0077 |
| WO | 2011/126120 | A1 | 10/2011 | |
| WO | 2012/010958 | A2 | 1/2012 | |

OTHER PUBLICATIONS (Three Bond Technical News, Issued Dec. 20, 1990).*
International Search Report in corresponding PCT application, dated Dec. 24, 2013.
Supplementary European Search Report dated May 13, 2016.
H. Shokrollahi et al., Investigation of Magnetic Properties, Residual Stress and Densification in Compacted Iron Powder Specimens Coated with Polyepoxy, Materials Chemistry and Physics, Apr. 15, 2009, 588-594, 114-2-3.
English Abstract for JP H09-223618 A dated Aug. 26, 1997.
English Abstract for JP 2008-063650 A dated Mar. 21, 2008.
English Abstract for JP 2003-124035 A dated Apr. 25, 2003.
English Abstract for JP H04-080901 A dated Mar. 13, 1992.
English Abstract for JP 2009-029842 A dated Feb. 12, 2009.
English Abstract of JP 05-183650 dated Jul. 30, 1993.

* cited by examiner

MAGNETIC CORE AND PROCESS FOR PRODUCING SAME

TECHNICAL FIELD

The present invention relates to a magnetic core and a process for producing the same and more particularly to an iron-based soft magnetic core to be mounted on a heating coil portion of a high frequency hardening apparatus and a process for producing the same.

BACKGROUND ART

The magnetic core has the effect of accelerating induction heating by concentrating lines of magnetic force on a workpiece and increasing the power of the coil in the case where the magnetic core is mounted on a rear surface of a coil and has the effect of preventing a portion not required to be hardened from being heated by shielding the lines of magnetic force in the case where the magnetic core is mounted on a front surface of the coil. Thus the magnetic core is a component part indispensable for the heating coil of the high frequency hardening apparatus For example, in the case where the workpiece to be subjected to high frequency hardening has a complicated configuration which necessitates a hardening depth to be adjusted, it is possible to change the state of the induction heating and control the hardening depth of the workpiece by altering the configuration, size, number, direction, and position of the core to be mounted on the heating coil. The material for the core is required to have (1) a satisfactory frequency characteristic, namely, to have a small change in the frequency change-caused inductance of the core, (2) a high saturation magnetic flux density, (3) a high relative permeability, and (4) a low iron loss.

To adapt the magnetic core to various configurations of the workpiece, it is often the case that parts of the core are produced in small lot production of many products. Thus in many cases, parts of the core are produced one by one by cutting work. Therefore materials for the core are demanded to have high strength and cutting workability.

Because powder-metallurgy processing is capable of producing the magnetic core with a low of raw materials and excellent in mass-productivity, the magnetic core produced by the powder-metallurgy processing is frequently used for the heating coil of the high frequency hardening apparatus.

As the magnetic core for an high frequency hardening coil, Fluxtrol A (trade name, produced by Fluxtrol Inc.) composed of iron particles fixed to one another with fluororesin and Poly-iron (trade name, produced by NEC Tokin Corporation) composed of sendust particles fixed to one another with phenol resin have been used. These magnetic cores have problems that the materials for the magnetic cores have a comparatively low strength, crack when a thin portion is cut, and are broken in mounting the magnetic cores on the coil.

As the magnetic core for use in an electric motor or a reactor, there is known the method for producing the powder magnetic core by mixing the magnetic powder having the insulation films formed on the surface of the pure iron powder thereof in advance and the silicon resin powder with each other, gelling the resin powder in the predetermined temperature atmosphere, and compression molding (warm molding) the mixture of the magnetic powder and the resin powder (patent document 1).

There is known the method for producing an oil-impregnated bearing made of iron by mixing the thermosetting epoxy resin with the reduced iron powder to such an extent that the porosity of the reduced iron powder is not reduced to a high extent, coating the surface of the reduced iron powder with the thermosetting epoxy resin, subjecting the mixture to compression molding, hardening, and impregnating the obtained bearing with oil (patent document 2).

PRIOR ART DOCUMENTS

Patent Documents

Patent document 1: Japanese Unexamined Patent Application Laid-Open Publication No. 2008-270539

Patent document 2: Japanese Examined Patent Application Publication No. 32-5052

SUMMARY OF THE INVENTION

Problem to be Solved by the Invention

In the method described in the patent document 1, it is necessary to use the expensive raw material iron powder having the insulation film formed on the surface of the pure iron powder before the pure iron powder and the silicon resin powder are mixed with each other. Further the resin powder is gelled by using the warm molding having low productivity and thereafter by compression molding the mixture of the magnetic powder and the resin powder. Therefore the method has problems that the raw material cost is high, the productivity is low, and the equipment cost is high.

In the case of the oil-impregnated bearing made of iron described in the patent document 2, the reduced iron powder is not sufficiently insulated and thus it is difficult to provide the magnetic core with preferable magnetic properties.

In the case where the magnetic core is used for the high frequency hardening coil, magnetic cores conventionally used have problems that the material used therefor has a low strength, the material cracks when a thin portion is cut, and the magnetic cores are broken in mounting them on the coil.

The present invention has been made to deal with the above-described problems. Therefore it is an object of the present invention to provide a magnetic core which can be produced with improved productivity without increasing a raw material cost and has magnetic and mechanical properties required by a soft magnetic core to be mounted on a heating coil portion or the like of a high frequency hardening apparatus and a process for producing the same.

Means for Solving the Problem

The magnetic core of the present invention is produced by compression molding and thereafter thermally hardening iron-based soft magnetic powder having resin films formed on surfaces of particles thereof. The resin film is an uncured resin film formed by dry mixing the iron-based soft magnetic powder and epoxy resin containing a latent curing agent with each other at a temperature not less than a softening temperature of the epoxy resin and less than a thermal curing starting temperature thereof. The iron-based soft magnetic powder having the resin films formed on the surfaces of the particles thereof is compression molded by using a die to produce a compression molded body. The compression molded body having the resin films formed on the surfaces of the particles thereof is thermally hardened at a temperature not less than the thermal curing starting temperature of the epoxy resin.

The iron-based soft magnetic powder is reduced iron powder. The iron-based soft magnetic powder passes through an 80-mesh sieve in Tyler sieve number (hereinafter referred to as merely 80-mesh sieve), but does not pass through a 325-mesh sieve.

The latent curing agent contained in the epoxy resin is dicyandiamide. The softening temperature of the epoxy resin containing the latent curing agent is 100 to 120° C.

The mixing ratio of the iron-based soft magnetic powder and that of the epoxy resin containing the latent curing agent is 95 to 99 mass % and 1 to 5 mass % respectively for the total amount of the iron-based soft magnetic powder and the epoxy resin containing the latent curing agent.

The magnetic core of the present invention is used for a high frequency hardening coil.

The process of the present invention for producing the magnetic core includes a mixing step of dry mixing the iron-based soft magnetic powder and the epoxy resin with each other at a temperature not less than the softening temperature of the epoxy resin and less than the thermal curing starting temperature thereof; a pulverizing step of pulverizing an agglomerated cake generated at the mixing step to obtain composite magnetic powder; a compression molding step of compression molding the composite magnetic powder into a compression molded body by using a die; and a hardening step of thermally hardening the compression molded body at a temperature not less than the thermal curing starting temperature of the epoxy resin. At the compression molding step, the composite magnetic powder is compression molded at a molding pressure of 200 to 500 MPa. At the hardening step, the compression molded body is thermally hardened at 170 to 190° C. At the hardening step, the compression molded body is thermally hardened in a nitrogen atmosphere.

Effect of the Invention

The magnetic core of the present invention is produced by compression molding and thereafter thermally hardening the iron-based soft magnetic powder having films of uncured epoxy resin containing the latent curing agent formed on the surfaces of the particles thereof. Therefore the process of the present invention for producing the magnetic core is capable of decreasing the occurrence of segregation between the iron powder and the resin powder different from each other in the specific gravities thereof to a higher extent than conventional methods for producing magnetic cores by simply mixing iron-based soft magnetic powder and resin powder with each other and in addition, improving the compressibility in compression molding the composite magnetic powder over the conventional methods. Consequently the magnetic core of the present invention is allowed to have an improved density.

The insulation film of the epoxy resin formed on the surface of the iron-based soft magnetic powder reduces the frequency of contact among the substrates of the iron particles and improves the frequency properties of the magnetic core related to the magnetic properties thereof.

The thermally cured epoxy resin formed on the surface of the iron-based soft magnetic powder contributes to the improvement of the strength of the material of the magnetic core and dramatically improves the mechanical strength of the present invention such as the radial crushing strength thereof. Further the hardening treatment to be performed in the nitrogen atmosphere reduces oxidation of the iron powder and restrains a decrease in the magnetic properties of the magnetic core such as its saturation magnetic flux density and relative permeability.

Owing to near net shape used in powder metallurgy, it is possible to improve the material yield, decrease the man-hour, improve the productivity, and decrease the cost in producing the magnetic core of the present invention. Thus the magnetic core of the present invention can be preferably used for the high frequency hardening coil.

MODE FOR CARRYING OUT THE INVENTION

An outside joint member of a constant velocity universal joint is produced from a cylindrical raw material through a forging step such as cold forging and thereafter subjected to high frequency hardening. A high frequency hardening operation is often performed by disposing the magnetic core on a front surface of a high frequency coil or a rear surface thereof to adjust the degree of hardening on the inner and outer surfaces of a cup portion of the outside joint member and a shaft portion thereof.

Figure 1:
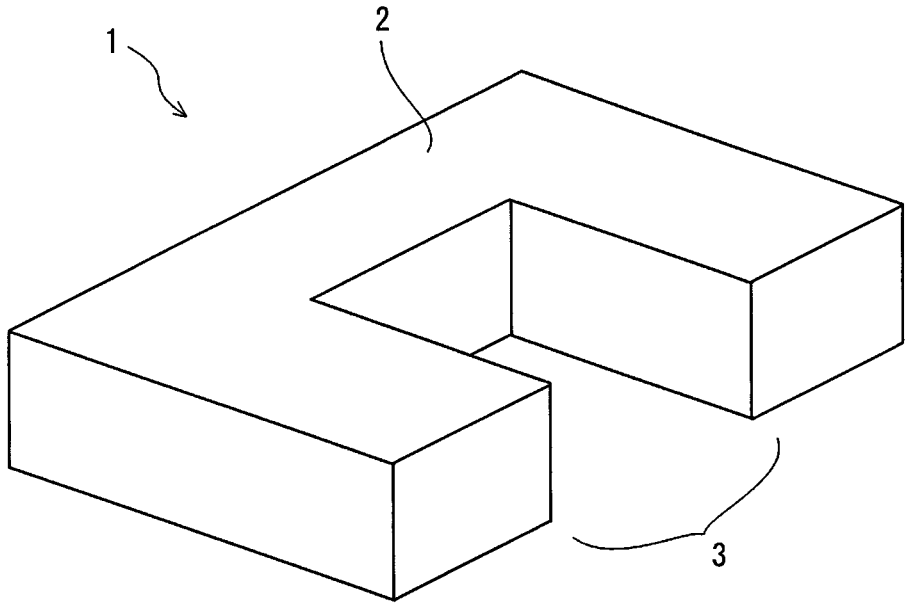
FIG. 1 is a perspective view of a magnetic core.

FIG. 1 shows one example of the magnetic core. FIG. 1 is a perspective view of the magnetic core. The magnetic core 1 is produced by compression molding and thereafter thermally hardening iron-based soft magnetic powder having resin films formed on the surfaces of particles thereof. Thereafter a compression molded body 2 is subjected to post-processing such as cutting work, barrel processing, and anti-rust treatment as necessary. In dependence on the configuration, size, and place of the high frequency coil, it is possible to appropriately alter the configuration and the like of the magnetic core to be disposed on the high frequency coil. The compression molded body 2, of a magnetic core 1 shown in FIG. 1, which is composed of epoxy resin powder and the iron-based soft magnetic powder is U-shaped. A U-shaped concave portion 3 of the compression molded body 2 is disposed on the front surface of the high frequency coil or the rear surface thereof.

As the iron-based soft magnetic powder which can be used in the present invention, it is possible to use the powder of pure iron, an iron-silicon alloy, an iron-nitrogen alloy, an iron-nickel alloy, an iron-carbon alloy, an iron-boron alloy, an iron-cobalt alloy, an iron-phosphorous alloy, an iron-nickel-cobalt alloy, and an iron-aluminum-silicon alloy (sendust alloy).

Of the above-described iron-based soft magnetic powder, the pure iron is favorable. Reduced iron powder and atomized iron power used in powder metallurgy are especially favorable. The reduced iron powder is more favorable than the atomized iron power because the produced magnetic core composed of the former is superior to the produced magnetic core composed of the latter in the mechanical property thereof. The reduced iron powder is produced by reducing iron oxides generated in iron-making factories with coke or the like and thereafter heat-treating the reduced iron oxides in a hydrogen atmosphere. The reduced iron powder has pores in its particles. The atomized iron powder is produced by powdering melted steel and cooling powdered steel with high-pressure water and thereafter heat-treating the powdered steel in a hydrogen atmosphere. The atomized iron powder does not have pores in its particles. In a photograph showing a sectional view of the reduced iron powder, a large number of concavities and convexes are detected. It is considered that the concavities and convexes affect the radial crushing strength shown in FIG. 6.

It is preferable that the iron-based soft magnetic powder passes through an 80-mesh sieve, but does not pass through a 325-mesh sieve. The opening of the 80-mesh sieve is 177 μm. The opening of the 325-mesh sieve is 44 μm. Thus the range of the particle diameter of the iron-based soft magnetic powder is 44 μm to 177 μm. It is preferable that the iron-based soft magnetic powder passes through a 100-mesh (149 μm) sieve, but does not pass through a 250-mesh (63 μm). It is difficult to form the resin film on the surfaces of fine iron particles which pass through the 325-mesh sieve. Iron powder which does not pass through the 80-mesh sieve has a high iron loss.

FIGS. 2 through 7 show the results of comparison between the reduced iron powder and the atomized iron powder and comparison among properties, of the reduced iron powder, different in dependence on diameters of the particles thereof.

As the reduced iron powder, (1) iron particles (hereinafter referred to as reduced iron powder) which pass through the 100-mesh sieve, but do not pass through the 325-mesh sieve and (2) iron particles (hereinafter referred to as reduced iron powder (fine powder)) which pass through the 325-mesh sieve are prepared. As the atomized iron powder, (3) atomized iron particles (hereinafter referred to as atomized iron powder) which pass through the 100-mesh sieve, but do not pass through the 325-mesh sieve are prepared.

Figure 2:
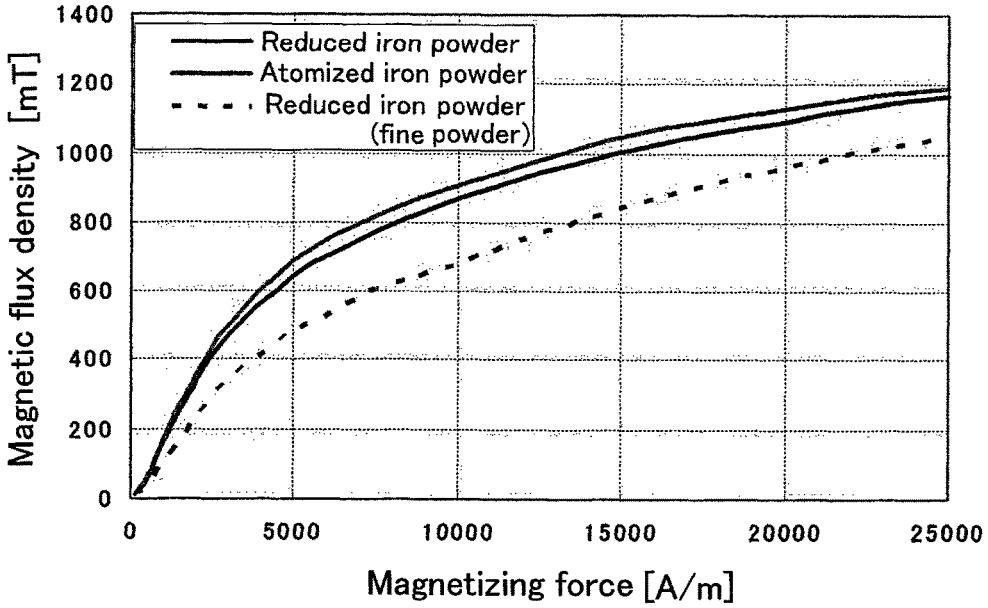
FIG. 2 shows a direct current B-H property.

After 2.7 mass % of epoxy resin powder containing a latent curing agent was added to 97.3 mass % of each of iron powder (1) through (3), each mixture was thermally kneaded at 110° C. by using a kneader. Thereafter each mixture was pulverized to produce three kinds of composite magnetic powder. After each composite magnetic powder was compression molded at a molding pressure of 400 MPa, each composite magnetic powder was hardened at 180° C. for one hour in a nitrogen atmosphere. Thereafter each composite magnetic powder was subjected to cutting work to obtain flat cylindrical magnetic cores each having an inner diameter of 7.6 mmφ, an outer diameter of 12.6 mmφ, a thickness of 5.7 mm. Each magnetic core was wound with a primary-side winding and a secondary-side winding to obtain toroidal specimens. Direct current B-H property was measured by measuring the magnetic flux density of the secondary-side winding when a magnetizing force (A/m) was changed by applying a direct current to the primary-side winding. FIG. 2 shows the results.

The result was that the B-H property of the reduced iron powder and that of the atomized iron powder were equal to each other and that the B-H property of the reduced iron powder (fine powder) was lower than those of the reduced iron powder and the atomized iron powder. In the case of the reduced iron powder (fine powder), conceivably, because it is difficult to uniformly form the resin film on the surface of the reduced iron powder (fine powder), the compressibility at a compression molding time is inferior, which leads to a decrease in the density of the magnetic core composed of the reduced iron powder (fine powder).

Figure 3:
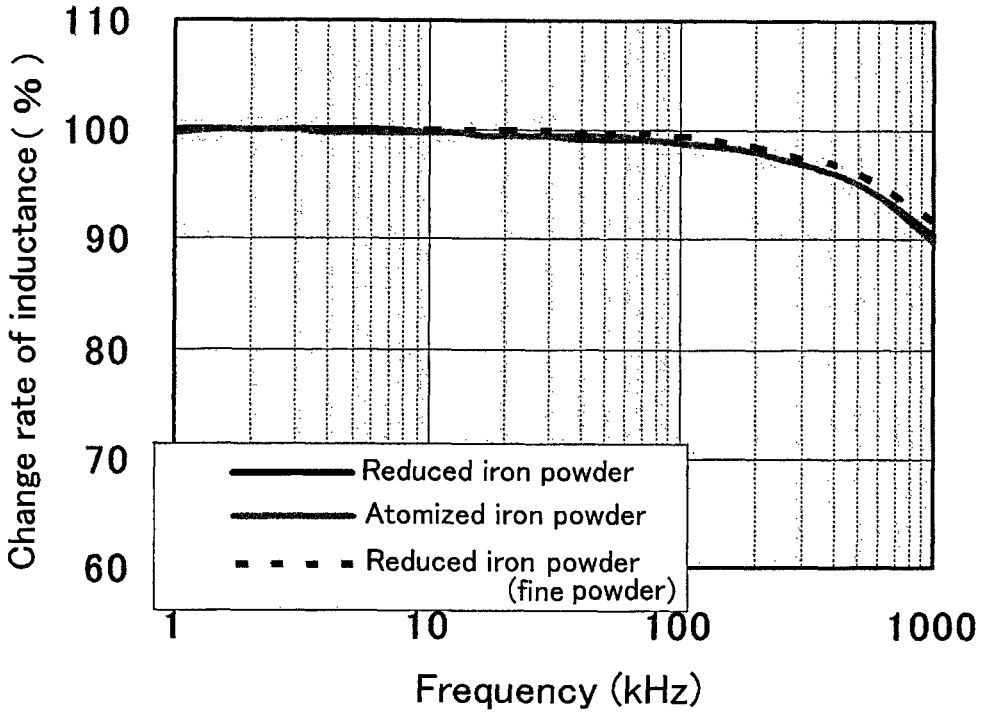
FIG. 3 shows the change of rate of an inductance.
Figure 4:
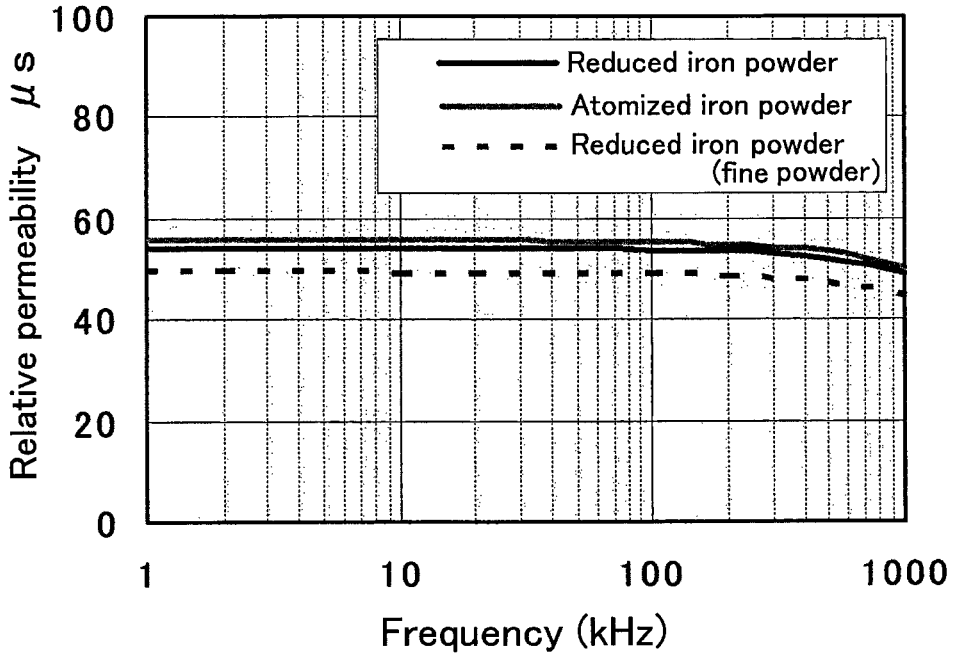
FIG. 4 shows a relative permeability.

Magnetic cores using the reduced iron powder, the atomized iron powder, and the reduced iron powder (fine powder) respectively were wound with winding by adjusting the number of turns thereof in such a way that the magnetic cores had an inductance of 10 μH. The inductance and relative permeability of each of the magnetic cores were measured when frequency was varied by setting an inductance at 1 kHz to 100%. FIGS. 3 and 4 show the results.

The reduced iron powder, the atomized iron powder, and the reduced iron powder (fine powder) had an equal change of rate in the inductance shown in FIG. 3. The reduced iron powder and the atomized iron powder had an almost equal relative permeability shown in FIG. 4. The relative permeability of the magnetic core the atomized iron powder (fine powder) was lower than those of the reduced iron powder and the atomized iron powder. As the reason for the result of the atomized iron powder (fine powder), conceivably, the resin film was not uniformly formed on the reduced iron powder (fine powder). In addition, the fine powder causes the compressibility thereof to be inferior to those of the reduced iron powder and the atomized iron powder, which leads to a decrease in the density of the reduced iron powder (fine powder).

Figure 5:
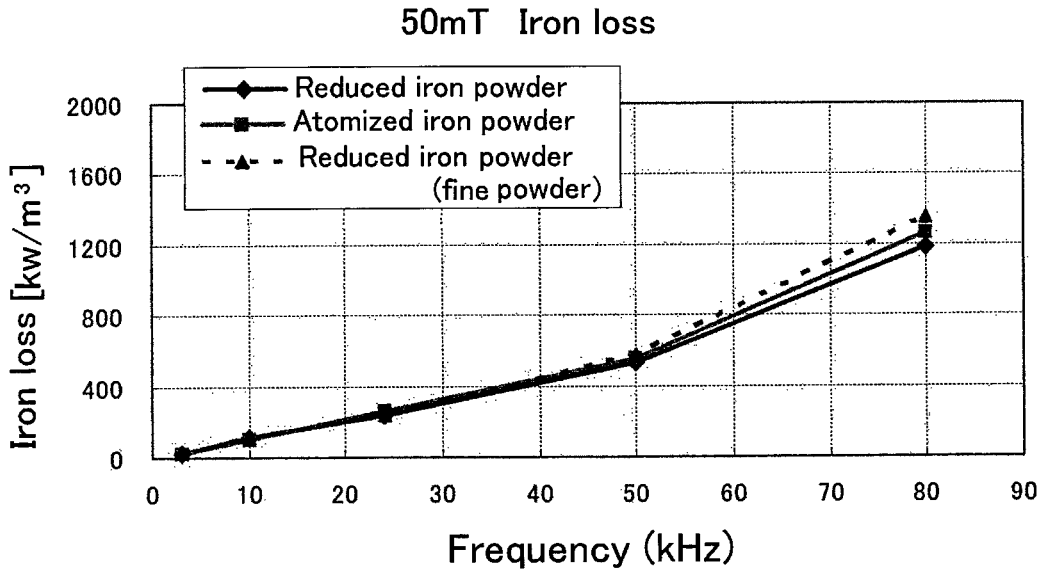
FIG. 5 shows an iron loss.

The iron loss of each of the reduced iron powder, the atomized iron powder, and the reduced iron powder (fine powder) was measured by using the above-described magnetic cores. FIG. 5 shows the results. As shown in FIG. 5, there was little difference in the iron loss between the reduced iron powder and the atomized iron powder. The iron loss of the reduced iron powder (fine powder) was slightly higher than those of the reduced iron powder and the atomized iron powder. Normally, the iron loss (eddy current loss) of single fine iron powder is lower than that of single iron powder having a larger diameter than the fine iron powder. But the order was reversed, as shown in FIG. 5. As the reason for this result, conceivably, because it is difficult to uniformly form the resin film on the reduced iron powder (fine powder), portions thereof not coated with an insulation film formed aggregates (apparent coarse powder) which caused the iron loss thereof to be higher than those of the reduced iron powder and the atomized iron powder.

Figure 6:
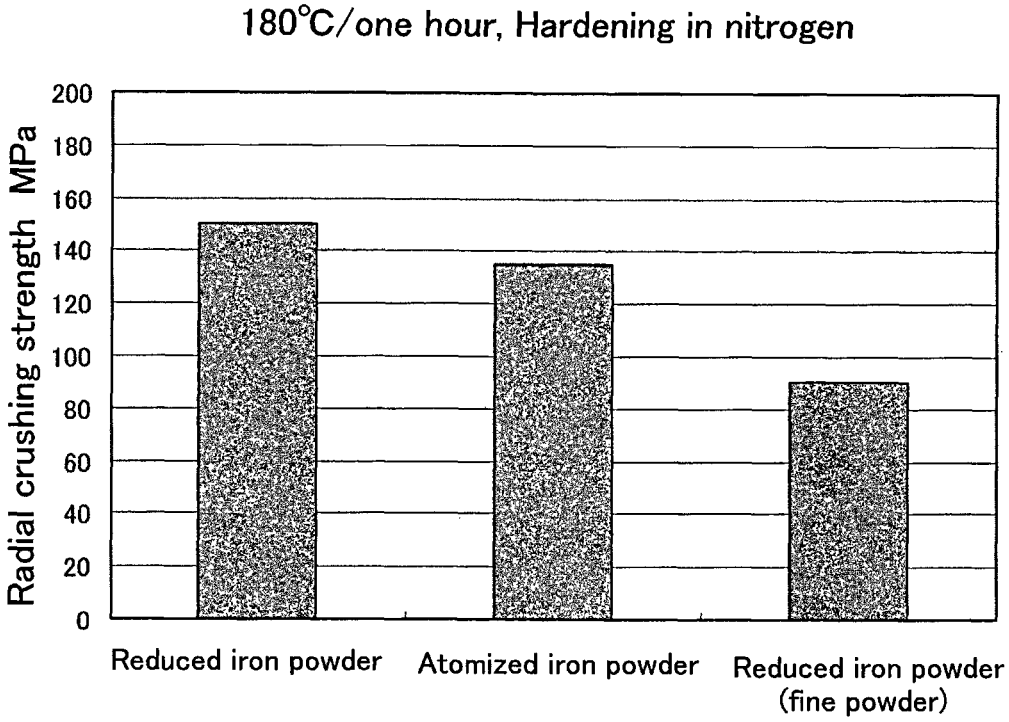
FIG. 6 shows radial crushing strengths different from one another in dependence on the kinds of iron powder.
Figure 7:
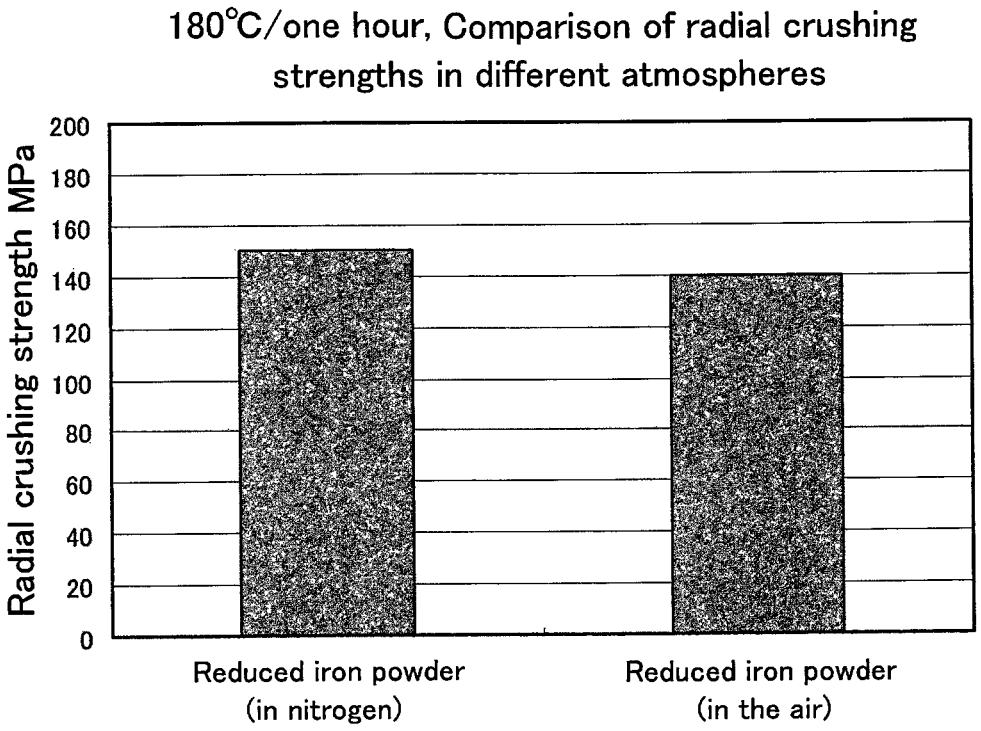
FIG. 7 shows radial crushing strengths different from each other in dependence on different hardening atmospheres.

The radial crushing strength of each of the magnetic cores was measured. In the measurement, a load was continuously applied to each magnetic core in its diametrical direction to measure the magnitude of the load when the magnetic core was destroyed. FIGS. 6 and 7 show the results of the measurement. FIG. 7 shows the comparison between the iron loss measured when the compression molded body was hardened in a nitrogen atmosphere at a temperature of 180° C. for one hour and the iron loss measured when the compression molded body was hardened in an air atmosphere at the temperature equal to the above for the period of time equal to the above.

As shown FIG. 6, the radial crushing strength of the magnetic core using the reduced iron powder was higher than that of the magnetic core using the atomized iron powder by about 10%. This is because the reduced iron particles were intertwined with one another to a higher extent than the atomized iron particles. The magnetic core using the reduced iron powder (fine powder) was lowest in the radial crushing strength thereof. As the reason for this result, conceivably, because it is difficult to uniformly form the resin film on the surface of the reduced iron powder (fine powder), iron metallic substrates contacted one another with a high frequency and thus there were a large number of portions where iron particles did not adhere to one another.

As shown FIG. 7, the radial crushing strength of the magnetic core measured when the compression molded body was hardened in the nitrogen atmosphere was higher than that of the magnetic core measured when the compression molded body was hardened in the air atmosphere. As the reason for this result, it is considered that a part of the surface of iron powder exposed was inhibited from being oxidized.

The above-described results indicate that the iron powder which can be preferably used in the present invention is the reduced iron powder which passes through the 80-mesh sieve, but does not pass through the 325-mesh sieve.

The epoxy resin which can be used in the present invention is resin which can be used as bonding epoxy resin and has a softening temperature of 100 to 120° C. For example, it is possible to use the epoxy resin which is solid at room temperature, becomes pasty at 50 to 60° C., becomes flowable at 130 to 140° C., and starts a curing reaction when the epoxy resin is further heated. Although the curing reaction starts in the neighborhood of 120° C., temperatures which allow the curing reaction to finish within two hours which are a practical curing period of time are preferably 170 to 190° C. In this temperature range, the curing period of time is 45 to 80 minutes.

Examples of the resin component of the epoxy resin include bisphenol A-type epoxy resin, bisphenol F-type epoxy resin, bisphenol S-type epoxy resin, hydrogenated bisphenol A-type epoxy resin, hydrogenated bisphenol F-type epoxy resin, stilbene-type epoxy resin, triazine skeleton-containing epoxy resin, fluorine skeleton-containing epoxy resin, alicyclic epoxy resin, novolak-type epoxy resin, acrylic epoxy resin, glycidyl amine-type epoxy resin, triphenylmethane-type epoxy resin, alkyl-modified triphenylmethane-type epoxy resin, biphenyl-type epoxy resin, dicyclopentadiene skeleton-containing epoxy resin, naphthalene skeleton-containing epoxy resin, and aryl alkylene type epoxy resin.

A curing component for the epoxy resin is a latent epoxy curing agent. By using the latent epoxy curing agent, it is possible to set the softening temperature of the epoxy resin to 100 to 120° C. and the curing temperature to 170 to 190° C. In this temperature range, it is possible to form the insulation film on the iron powder and thereafter compression mold the composite magnetic powder and thermally harden the compression molded body.

As the latent epoxy curing agent, dicyandiamide, boron trifluoride-amine complex, organic acid hydrazide, and the like are listed. Of these latent epoxy curing agents, the dicyandiamide suitable for the above-described curing condition of the epoxy resin is preferable.

The epoxy resin may contain a curing accelerator such as tertiary amine, imidazole, and aromatic amine in addition to the latent epoxy curing agent.

The latent curing agent is added to the epoxy resin which can be used in the present invention in such a way that the epoxy resin containing the latent curing agent cures at 160° C. with the lapse of two hours, at 170° C. with the lapse of 80 minutes, at 180° C. with the lapse of 55 minutes, at 190° C. with the lapse of 45 minutes, and at 200° C. with the lapse of 30 minutes.

As the mixing ratio of the iron-based soft magnetic powder and the epoxy resin, it is preferable to set the mixing ratio of the iron-based soft magnetic powder and that of the epoxy resin containing latent curing agent to 95 to 99 mass % and to 1 to 5 mass % respectively for the total amount of the iron-based soft magnetic powder and the epoxy resin. This is because in the case where the mixing ratio of the epoxy resin is less than 1 mass %, it is difficult to form the insulation film. In the case where the mixing ratio of the epoxy resin is more than 5 mass %, the obtained magnetic core has low magnetic properties, and coarse aggregates rich in the resin are generated.

In the magnetic core of the present invention, by dry mixing the iron-based soft magnetic powder and the epoxy resin with each other at a temperature of 100 to 120° C., an uncured resin film is formed on the surface of the iron-based soft magnetic powder. The uncured resin film is the insulation film. The cured resin film is also the insulation film. Because the insulation properties of the resin film are maintained, the magnetic core has improved magnetic properties.

The iron-based soft magnetic powder having the insulation film formed on the surface thereof is compression molded into a molded body by using a die. Thereafter the compression molded body is thermally hardened at temperatures not less than the thermal curing starting temperature of the epoxy resin to obtain the magnetic core in which the iron-based soft magnetic powder and the epoxy resin have been integrated with each other.

The magnetic core of the present invention is excellent in its mechanical properties such as its magnetic properties and radial crushing strength. The molded body can be cut with high workability. Consequently it is possible to easily produce magnetic cores which are thin or have a special configuration. Therefore the magnetic core of the present invention can be utilized for an outside joint member of a constant velocity universal joint and the like.

Figure 8:
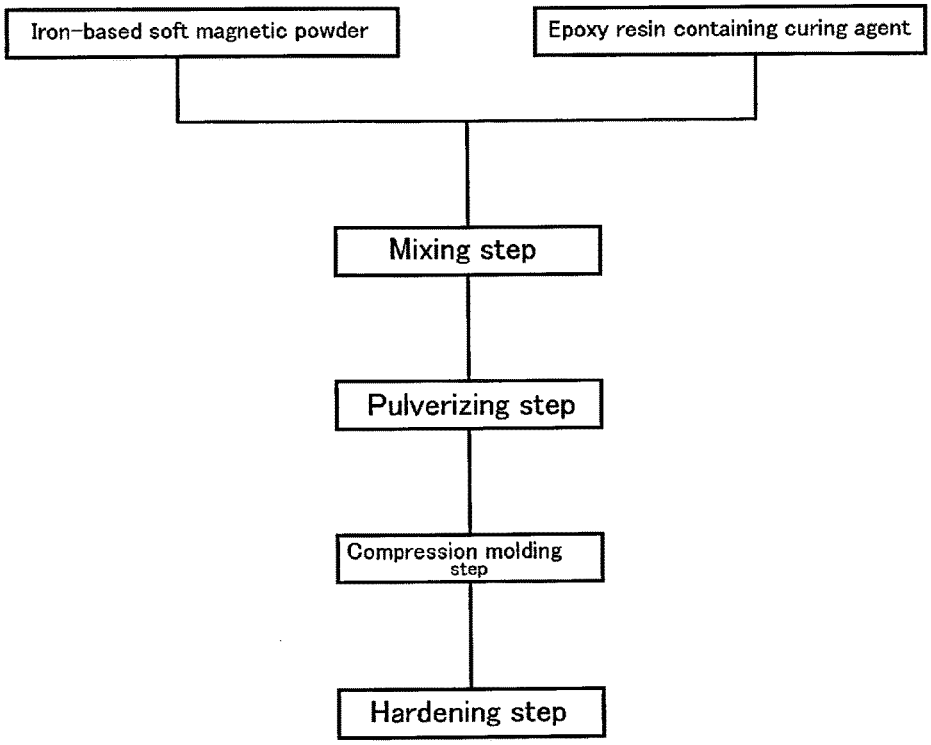
FIG. 8 shows a production process diagram.

The process for producing the magnetic core is described below with reference to FIG. 8. FIG. 8 shows a production process diagram.

The iron-based soft magnetic powder and the epoxy resin to which the latent curing agent has been added are prepared. The iron-based soft magnetic particles are divided into particles which pass through the 80-mesh sieve, but do not pass through the 325-mesh sieve and particles having other sizes in advance by using a classifier.

At a mixing step, the iron-based soft magnetic powder and the epoxy resin are dry mixed with each other at temperatures not less than the softening temperature of the epoxy resin and less than the thermal curing starting temperature thereof. At the mixing step, initially, the iron-based soft magnetic powder and the epoxy resin are sufficiently mixed with each other at room temperature by using a blender or the like. Thereafter the mixture is supplied to a mixer such as a kneader to hot mix the mixture at the softening temperature (100 to 120° C.) of the epoxy resin. At the hot mixing step, the insulation film of the epoxy resin is formed on the surface of the iron-based soft magnetic powder. At this step, the epoxy resin is uncured.

The hot mixed contents agglomerate and becomes like a cake. At a pulverizing step, by pulverizing the agglomerated cake at room temperature and sieving it, composite magnetic powder having the insulation film of the epoxy resin formed on the surface thereof is obtained. It is preferable to use a Henschel mixer to pulverize the agglomerated cake. It is preferable to use iron particles which pass through a 60-mesh sieve.

As a die to be used at a compression molding step, it is possible to use dies capable of applying a molding pressure of 200 to 500 MPa to the pulverized composite magnetic powder. When the molding pressure is less than 200 MPa, the molded body has low magnetic properties and strength. When the molding pressure is more than 500 MPa, the epoxy resin fixes to the inner wall of the die.

The molded body taken out from the die is thermally hardened at 170 to 190° C. for 45 to 80 minutes. At less than 170° C., it takes long to harden the molded body. On the other hand, at more than 190° C., the molded body starts to deteriorate. It is preferable to thermally harden the molded body in a nitrogen atmosphere.

After the molded body is thermally hardened, the molded body is subjected to cutting work, barrel processing, and anti-rust treatment to obtain the magnetic core.

EXAMPLES

Example 1 and Comparative Examples 1 and 2

Ninety seven point three grams of iron particles which pass through the 100-mesh sieve, but do not pass through the 250-mesh sieve and 2.7 g of epoxy resin powder containing dicyandiamide as a curing agent were mixed with each other at room temperature for 10 minutes by using a blender. The mixture was supplied to a kneader to thermally knead it at 110° C. for 15 minutes. After an agglomerated cake was taken out from the kneader and cooled, it was pulverized by a pulverizer. Thereafter the agglomerated cake was compression molded at a molding pressure of 400 MPa by using a die. After the compression molded body was taken out from the die, it was hardened at 180° C. for one hour in a nitrogen atmosphere. Thereafter the compression molded body was subjected to cutting work to produce a magnetic core.

The above-described magnetic property measuring toroidal specimens were prepared to measure the magnetic properties thereof by the above-described method. Specimens each having a thickness of 10 mm×25 mm×3 mm were prepared to measure the surface hardness, volume resistance, and surface electrical resistance thereof. Table 1 shows the results of the measurements.

A magnetic core (comparative example 1) composed of iron powder fixed to one another with polytetrafluoroethylene and having the same configuration as that of the above-described specimens and a magnetic core (comparative example 2) composed of sendust powder fixed to one another with phenol resin and having the same configuration as that of the above-described specimens were prepared to make evaluation in the same manner as that of the example 1. The magnetic cores of the comparative examples 1 and 2 had a low mechanical strength and were broken and cracked when a thin portion was cut. Table 1 shows the results.

TABLE 1

| | | Example 1 | Comparative example 1 | Comparative example 2 |
|---|---|---|---|---|
| Saturation magnetic flux density mT | | ≈1300 | ≈1200 | ≈500 |
| Frequency properties Inductance change rate % | 1 kHz | 100 | 100 | 100 |
| | 1000 kHz | 90.3 | 89.7 | 99.1 |
| Relative permeability μs | 1 kHz | 54 | 40 | 21 |
| Iron loss KW/m$^3$ | 10 kHz/200 mT | 1490 | 1690 | 1120 |
| | 50 kHz/100 mT | 2270 | 2760 | 2070 |
| Temperature properties Inductance change rate % | 25° C. | 100 | 100 | 100 |
| | 130° C. | 103.8 | 109.1 | 114.3 |
| Radial crushing strength(MPa) | | 150 | 30 | 50 |

TABLE 1-continued

| | Example 1 | Comparative example 1 | Comparative example 2 |
|---|---|---|---|
| Hardness(HRH) | 82.5 | 74 | 99.5 |
| Volume resistance (Ω · cm) | 2.00E−01 | 6.70E+00 | 2.60E+05 |
| Surface resistance(Ω/□) | 7.10E−01 | 1.60E+01 | 7.90E+05 |
| Density(g/cm$^3$) | 6.1 | 6.4 | 4.6 |

INDUSTRIAL APPLICABILITY

Because the magnetic core of the present invention is excellent in its economy, magnetic properties, and material strength, the magnetic core can be utilized as a general-purpose magnetic core. In addition, the magnetic core can be also utilized as a soft magnetic core to be mounted on the heating coil portion of the high frequency hardening apparatus required to have a complicated configuration.

EXPLANATION OF REFERENCE NUMERALS AND SYMBOLS

1: magnetic core
2: compression molded body
3: concave portion

The invention claimed is:

1. A magnetic core produced by compression molding iron-based soft magnetic powder having a resin film comprising an epoxy resin formed on surfaces of particles of said iron-based soft magnetic powder and thereafter thermally hardening said epoxy resin in said resin films, wherein a radial crushing strength of said magnetic core is 90 to 150 MPa, wherein said iron-based soft magnetic powder passes through a number 100 mesh Tyler sieve, but does not pass through a number 325-mesh Tyler sieve and wherein said resin film before compression molding is an uncured epoxy resin film formed by dry mixing said iron-based soft magnetic powder and said epoxy resin containing a latent curing agent at a temperature not less than a softening temperature of said epoxy resin containing said latent curing agent and less than a thermal curing starting temperature of said epoxy-resin containing said latent curing agent;

said latent curing agent is dicyandiamide;

said softening temperature of said epoxy resin containing said latent curing agent is 100 to 120° C.;

said iron-based soft magnetic powder having said resin films formed on said surfaces of said particles of said iron-based soft magnetic powder is compression molded by using a die to produce a compression molded body; and said compression molded body having said epoxy resin film formed on said surfaces of said particles of said magnetic powder is thermally hardened at a temperature not less than said thermal curing starting temperature of said epoxy resin containing said latent curing agent.

2. A magnetic core according to claim 1, wherein said iron-based soft magnetic powder is reduced iron powder.

3. A magnetic core according to claim 1, wherein a mixing ratio of said iron-based soft magnetic powder and that of said epoxy resin containing said latent curing agent is 95 to 99 mass % and 1 to 5 mass % respectively for a total amount of said iron-based soft magnetic powder and said epoxy resin containing said latent curing agent.

4. A magnetic core produced by compression molding iron-based soft magnetic powder as defined in claim 1 wherein a radial crushing strength of said magnetic core is 140 to 150 MPa.

5. A process for producing a magnetic core according to claim 1 comprising: a mixing step of dry mixing said iron-based soft magnetic powder and said epoxy resin containing said latent curing agent with each other at a temperature not less than said softening temperature of said epoxy resin and less than said thermal curing starting temperature thereof; a pulverizing step of pulverizing an agglomerated cake generated at said mixing step to obtain composite magnetic powder; a compression molding step of compression molding said composite magnetic powder into a compression molded body by using a die; and a hardening step of thermally hardening said compression molded body at a temperature not less than said thermal curing starting temperature of said epoxy resin.

6. A process for producing a magnetic core according to claim 5, wherein at said compression molding step, said composite magnetic powder is compression molded at a molding pressure of 200 to 500 MPa.

7. A process for producing a magnetic core according to claim 5, wherein at said hardening step, said compression molded body is thermally hardened at 170 to 190° C.

8. A process for producing a magnetic core according to claim 7, wherein at said hardening step, said compression molded body is thermally hardened in a nitrogen atmosphere.

* * * * *